US009876273B2

(12) United States Patent
Lui et al.

(10) Patent No.: US 9,876,273 B2
(45) Date of Patent: Jan. 23, 2018

(54) ELECTRONIC DEVICE HAVING ANTENNA ON GROUNDED SPEAKER BOX

(71) Applicant: Apple Inc., Cupertino, CA (US)

(72) Inventors: Timothy S. Lui, San Jose, CA (US); Robert F. Meyer, Palo Alto, CA (US); Stoyan P. Hristov, San Jose, CA (US); Ashley E. Fletcher, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 41 days.

(21) Appl. No.: 14/844,911

(22) Filed: Sep. 3, 2015

(65) Prior Publication Data

US 2017/0069954 A1 Mar. 9, 2017

(51) Int. Cl.
*H01Q 1/24* (2006.01)
*H01Q 1/44* (2006.01)
*H01Q 9/42* (2006.01)

(52) U.S. Cl.
CPC ..... *H01Q 1/243* (2013.01); *H01Q 1/241* (2013.01); *H01Q 1/242* (2013.01); *H01Q 1/44* (2013.01); *H01Q 9/42* (2013.01)

(58) Field of Classification Search
CPC ..... H01Q 1/24; H01Q 1/241; H01Q 1/242; H01Q 1/243
See application file for complete search history.

(56) References Cited

U.S. PATENT DOCUMENTS

| | | | | |
|---|---|---|---|---|
| 7,760,145 | B2 | 7/2010 | Gold | |
| 8,660,623 | B2 | 2/2014 | Man et al. | |
| 8,665,159 | B2 | 3/2014 | Kuo et al. | |
| 9,077,074 | B2 * | 7/2015 | Miyagawa | H01Q 1/243 |
| 9,411,380 | B2 * | 8/2016 | Farahani | G06F 1/1656 |
| 9,484,631 | B1 * | 11/2016 | Napoles | H01Q 5/50 |
| 2014/0009344 | A1 * | 1/2014 | Zhu | H01Q 1/2266 343/702 |
| 2015/0220172 | A1 | 8/2015 | Garcia et al. | |
| 2015/0245513 | A1 | 8/2015 | Moon | |

* cited by examiner

*Primary Examiner* — Hoang Nguyen
(74) *Attorney, Agent, or Firm* — Treyz Law Group, P.C.; G. Victor Treyz; Michael H. Lyons

(57) ABSTRACT

An electronic device may be provided with a housing in which electrical components are mounted. The housing may include a metal portion that serves as ground. An antenna for the electronic device may be formed from metal traces on an antenna support such as a flexible printed circuit. The flexible printed circuit may be mounted to a speaker box. The speaker box may have one or more walls formed from metal plates. A metal plate in a speaker box may be coupled to a metal clip. The metal clip may be shorted to a metal stiffener that overlaps a tail portion of the flexible printed circuit. The metal stiffener may have an opening that is aligned with an opening in the metal clip. A metal fastener such as a screw may pass through the openings to short the metal clip, stiffener, and metal plate to ground.

20 Claims, 7 Drawing Sheets

ELECTRONIC DEVICE HAVING ANTENNA ON GROUNDED SPEAKER BOX

BACKGROUND

This relates generally to electronic devices and, more particularly, to electronic devices with wireless communications circuitry.

Electronic devices often include wireless circuitry with antennas. For example, cellular telephones, computers, and other devices often contain antennas for supporting wireless communications.

It can be challenging to form electronic device antenna structures with desired attributes. In some wireless devices, the presence of conductive structures such as conductive housing structures and conductive components can influence antenna performance. Antenna performance may not be satisfactory if the housing structures are not configured properly and interfere with antenna operation or if antennas are undesirably influenced due to conductive structures in nearby components. Device size can also affect performance. It can be difficult to achieve desired performance levels in a compact device, particularly when the compact device has conductive components and housing structures.

It would therefore be desirable to be able to provide improved wireless circuitry for electronic devices such as electronic devices that include conductive structures.

SUMMARY

An electronic device may be provided with a housing in which electrical components are mounted. The housing may include a metal portion that serves as ground.

An antenna for the electronic device may be formed from metal traces on an antenna support such as a flexible printed circuit. The flexible printed circuit may be mounted to a speaker box under an inactive edge portion of a display.

The speaker box may have one or more walls formed from metal plates. The metal plates may have portions that are secured within molded plastic speaker box wall structures.

A metal plate in a speaker box may be coupled to a metal clip. The metal plate may be formed in a first speaker box portion and the metal clip may be formed in a second speaker box portion. The metal clip and metal plate may be welded to each other after joining the first and second speaker box portions.

The metal clip may be shorted to a metal stiffener that overlaps a tail portion of the flexible printed circuit. The metal stiffener may serve as a mechanical support for the flexible printed circuit and may form part of a signal path that helps ground the metal plate. A coaxial cable may be soldered or otherwise mounted to contact pads on the flexible printed circuit tail portion.

The metal stiffener may have an opening that is aligned with an opening in the metal clip. A metal fastener such as a screw may pass through the openings to short the metal clip, stiffener, and metal plate to ground.

DETAILED DESCRIPTION

Figure 1:
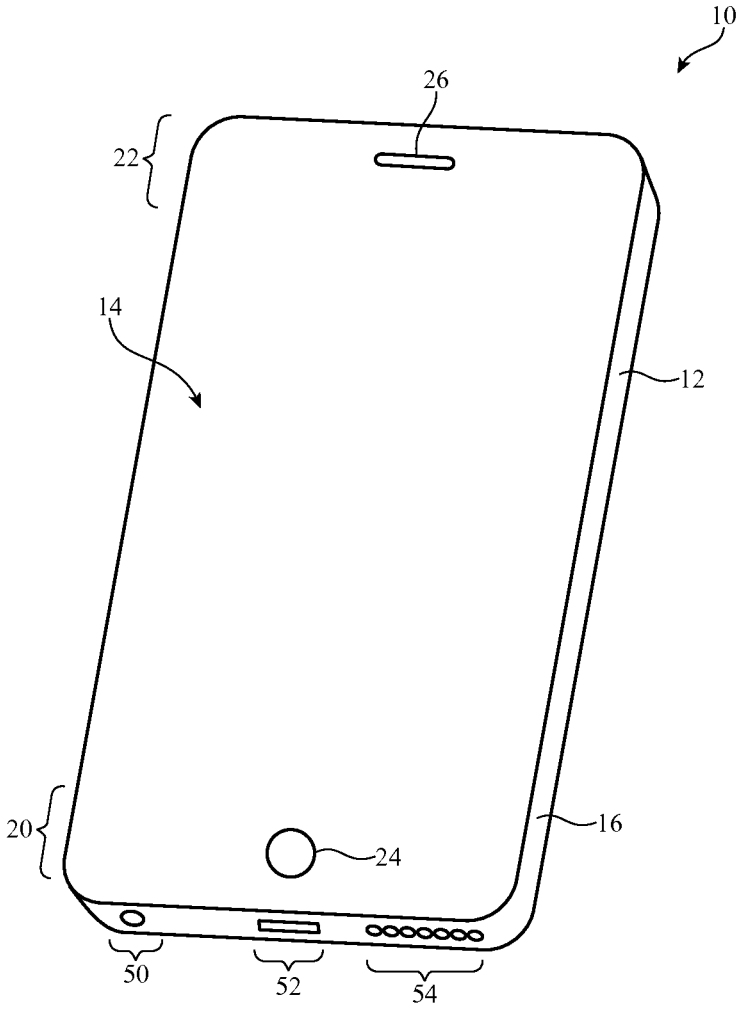
FIG. 1 is a perspective view of an illustrative electronic device in accordance with an embodiment.

Electronic devices such as electronic device 10 of FIG. 1 may be provided with wireless communications circuitry. The wireless communications circuitry may be used to support wireless communications in multiple wireless communications bands.

The wireless communications circuitry may include one more antennas. The antennas of the wireless communications circuitry can include loop antennas, inverted-F antennas, strip antennas, planar inverted-F antennas, slot antennas, hybrid antennas that include antenna structures of more than one type, or other suitable antennas.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch.

The rear face of housing 12 (i.e., the face of device 10 opposing the front face of device 10) may have a planar housing wall.

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. Buttons such as button 24 may pass through openings in the cover layer. The cover layer may also have other openings such as an opening for speaker port 26. Housing 12 may have openings such as openings for audio jack port 50, connector port 52, and speaker port 54.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may also, if desired, form sidewall structures for device 10 (e.g., by forming a metal band with vertical sidewalls, curved sidewalls, etc.). Peripheral housing structures 16 may be formed from metal such as stainless steel, aluminum, or other suitable materials and may form antenna ground structures, portions of antenna resonating elements (e.g., inverted-F antennas and other antennas for cellular telephone communications, etc.). Other conductive housing structures (e.g., a planar rear wall for device housing 12) may also be formed from metal such as stainless steel, aluminum, or other suitable materials and may form ground structures (e.g., antenna ground).

Display 14 may have an array of pixels that form an active area that displays images for a user of device 10. An inactive border region may run along one or more of the peripheral edges of the active area. Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a midplate) that spans the walls of housing 12 (i.e., a substantially rectangular sheet formed from one or more parts that is welded or otherwise connected between opposing sides of member 16). Device 10 may also include conductive structures such as printed circuit boards, components mounted on printed circuit boards, and other internal conductive structures. These conductive structures, which may be used in forming a ground in device 10, may be located in the center of housing 12 and may extend under the central active area of display 14.

In inactive display regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings may be filled with air, plastic, and other dielectrics and may be used in forming antenna resonating elements for one or more antennas in device 10.

If desired, antenna traces on a flexible printed circuit or other carrier may be used to form antenna resonating elements (e.g., resonating elements for a monopole antenna, inverted-F antenna, etc.). A flexible printed circuit may have a flexible substrate formed from a layer of polyimide or other flexible sheet(s) of polymer. The flexible printed circuit on which the antenna resonating element has been formed may be mounted in a location in device 10 that allows the antenna to transmit and receive wireless signals. With one suitable arrangement, one or more wireless local area network antennas may be formed from flexible printed circuit(s) mounted under one or more portions of the display cover layer for display 14 in inactive areas of display 14 such as areas 20 and/or 22. During operation, these antennas may transmit and receive antenna signals that have passed through dielectric portions of device 10 such as the overlapping portions of the display cover layer. If desired, housing 12 may be formed from dielectric and/or may be formed from metal with dielectric antenna windows located over the antennas to permit antenna signals to be transmitted and received by the antennas through the housing.

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations.

In a typical scenario, device 10 may have one or more upper and one or more lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme (e.g., a wireless local area network MIMO scheme).

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
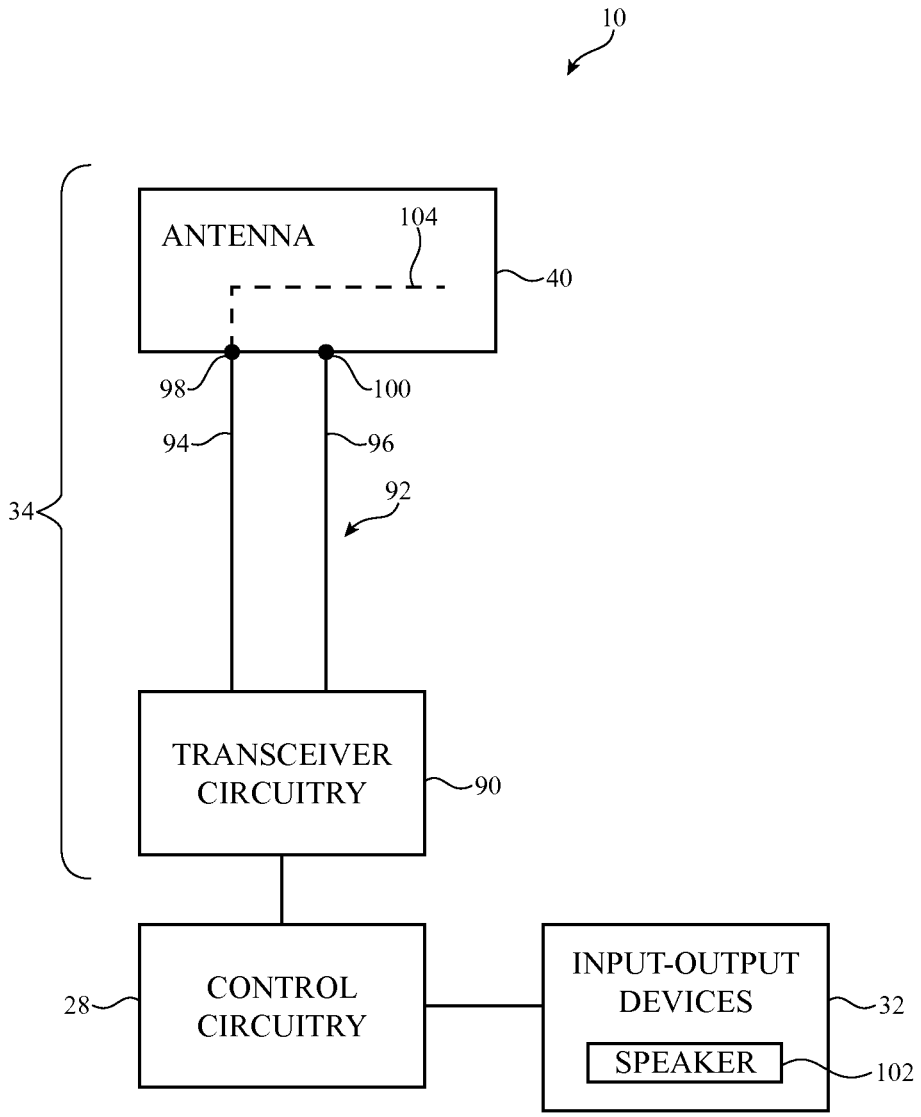
FIG. 2 is a schematic diagram of illustrative circuitry in an electronic device in accordance with an embodiment.

A schematic diagram of device 10 is shown in FIG. 2. As shown in FIG. 2, transceiver circuitry 90 in wireless circuitry 34 may be coupled to antenna structures such as antenna 40 using paths such as path 92. Wireless circuitry 34 may be coupled to control circuitry 28. Control circuitry 28 may be storage and processing circuitry that includes storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in circuitry 28 may be used to control the operation of device 10. This processing circuitry may be based on one or more microprocessors, microcontrollers, digital signal processors, application specific integrated circuits, etc.

Control circuitry 28 may be used to run software on device 10, such as internet browsing applications, voice-over-internet-protocol (VOIP) telephone call applications, email applications, media playback applications, operating system functions, etc. To support interactions with external equipment, circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, multiple-input and multiple-output (MIMO) protocols, antenna diversity protocols, etc.

Control circuitry 28 may be coupled to input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors (e.g., a fingerprint sensor integrated with a button such as button 24 of FIG. 1 or a fingerprint sensor that takes the place of button 24), etc.

To provide antenna structures such as antenna(s) 40 with the ability to cover communications frequencies of interest, antenna(s) 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna(s) 40 may be provided with adjustable circuits to tune antennas over communications bands of interest.

Path 92 may include one or more transmission lines. As an example, signal path 92 of FIG. 2 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna(s) 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Transmission line 92 may be coupled to antenna feed structures associated with antenna 40. As an example, antenna 40 may be formed from an antenna resonating element trace on a flexible printed circuit (see, e.g., trace 104 of FIG. 2). The antenna resonating element trace and an antenna ground (e.g., a ground formed from a portion of housing 12, ground traces in one or more printed circuits, etc.) may be used to form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 100. Other types of antenna feed arrangements may be used if desired. For example, antenna structures 40 may be fed using multiple feeds. The illustrative feeding configuration of FIG. 2 is merely illustrative.

Figure 3:
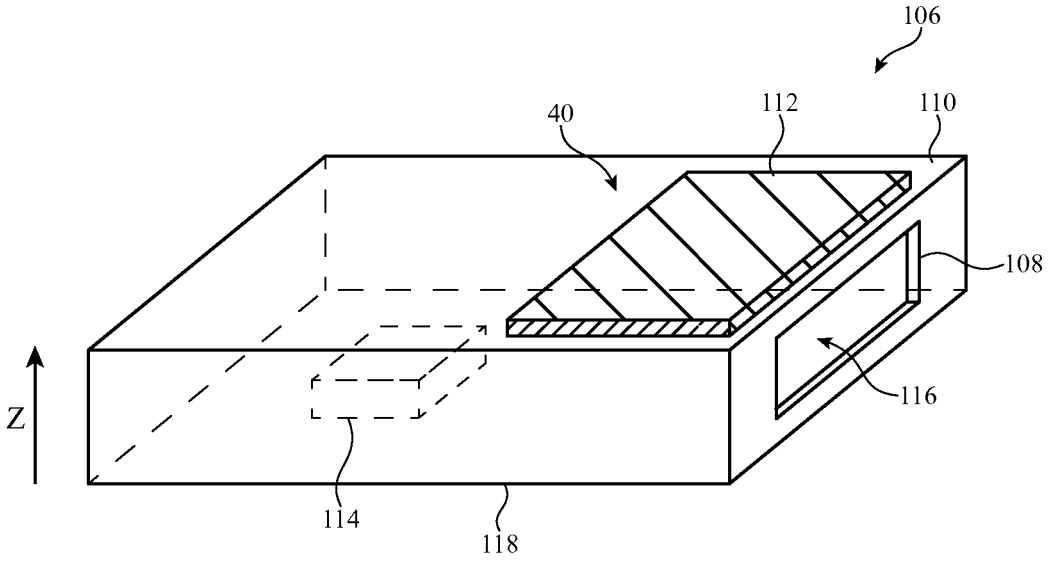
FIG. 3 is perspective view of an illustrative speaker box being used to support an antenna in accordance with an embodiment.

A speaker such as speaker 106 of FIG. 3 may have an opening such as opening 108 that is aligned with speaker port 54 of FIG. 1. Speaker 106 may have a speaker driver such as driver 114 that is located in interior cavity (speaker volume) 116 of speaker box 118. Speaker box 118, which may sometimes be referred to as a speaker enclosure, may have a wall such as upper wall 110. An antenna support structure such as flexible printed circuit 112 may contain antenna traces for forming antenna 40 and may be mounted on upper wall 110 using adhesive or other suitable attachment mechanisms. Speaker 106 and, in particular, antenna 40 on speaker box 118, may be installed under an inactive portion of display 14 (e.g., under a display cover layer region that serves as an antenna window).

Opening 108 in speaker box 118 may allow sound to pass from interior region 116 to the exterior of device 10 via speaker port 54 (e.g., through one or more openings in housing 12). At the same time, speaker box 118 may serve as a support that holds flexible printed circuit 112 of antenna 40 at a desired distance in dimension Z from underlying ground structures (e.g., metal housing structures under box 118, ground lines in printed circuits that are overlapped by box 118, etc.). Speaker box 118 may have any suitable hollow shape (e.g., a spherical shape, a rectangular box shape, a shape with curved and/or flat portions, etc.). The use of a rectangular box shape for speaker box 118 of FIG. 3 is merely illustrative.

The walls of speaker box 118 may be formed from materials such as plastic and/or metal. Metal walls (e.g., walls of stainless steel, etc.) may be relatively thin for a given strength, and may therefore be used to help reduce the overall thickness of box 118. The use of metal plates to form one or more of the walls of box 18 therefore allows the volume of interior cavity 116 to be increased without increasing the exterior dimensions of box 118.

Figure 4:
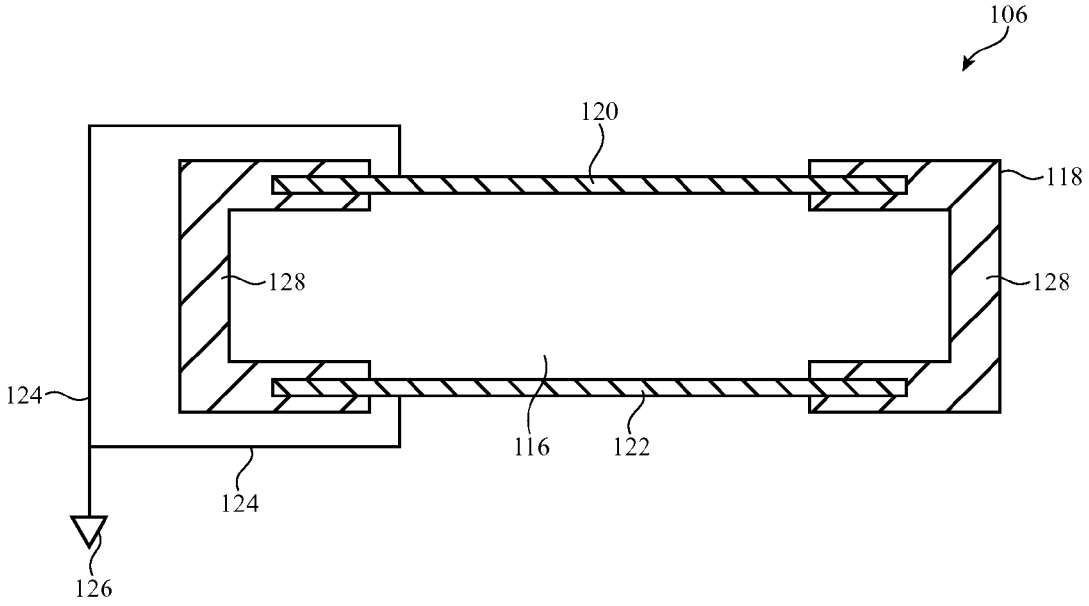
FIG. 4 is a cross-sectional side view of an illustrative speaker box showing how portions of the walls of the speaker box may be formed from metal plates in accordance with an embodiment.

A cross-sectional side view of speaker box 118 of speaker 106 in an illustrative configuration in which box 118 has an upper metal plate and opposing lower metal plate is shown in FIG. 4. As shown in FIG. 4, metal plate 120 may form part or all of an upper wall for speaker box 118 and metal plate 122 may form part or all of a lower wall for speaker box 118, and plastic sidewall structures 128 may be formed from plastic that is injection molded over the outer edges of metal plates 120 and 122. Metal plates 120 and 122 have the potential to influence antenna operation for antenna 40. To enhance antenna performance, ground paths such as paths 124 may be used to short (ground) plates 120 and 122 to ground 126. Ground 126 may be associated with ground traces in a printed circuit that runs under box 118, metal in housing 12, or other ground structures. Paths 124 may be formed from ground path structures such as metal wires, traces in flexible printed circuits, metal clips (e.g., metal structures embedded in plastic portions of box 118 and/or coupled to metal plates 120 and/or 122), metal stiffener structures, or other conductive structures.

Figure 5:
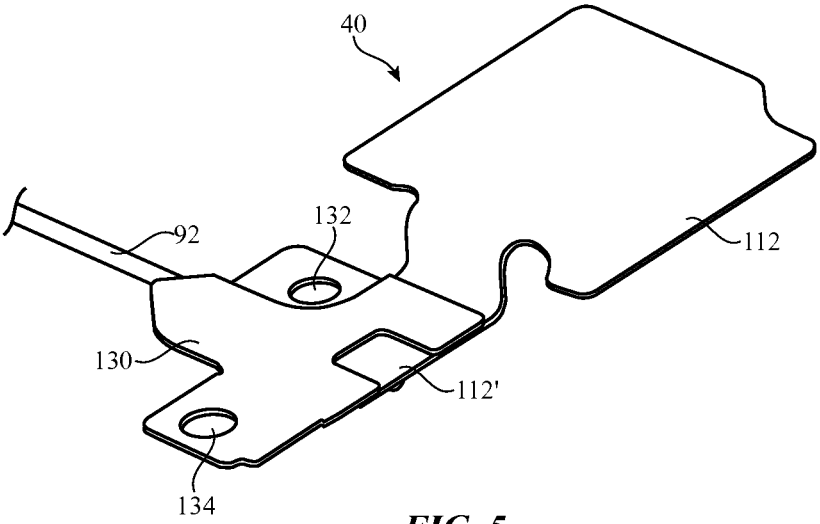
FIG. 5 is a perspective view of an illustrative flexible printed circuit having antenna traces that form an antenna and having a metal grounded stiffener in accordance with an embodiment.

A perspective view of flexible printed circuit 112 is shown in FIG. 5. Flexible printed circuit 112 may contain a patterned metal layer (e.g., a copper layer) and one or more dielectric layers (e.g., a layer of polyimide substrate, a coverlay layer that covers the metal layer, vias for routing signals to contact pads, etc.). The metal traces in printed circuit 112 may be patterned to form antenna resonating element 104 of antenna 40 (FIG. 2). In the example of FIG. 5, flexible printed circuit 112 has a tail portion such as tail 112' that extends downwards from the top surface of box 118 (not shown in FIG. 5). Tail 112' is overlapped and stiffened using stiffener 130. Stiffener 130 may be formed from a sheet of metal (e.g., a planar stamped stainless steel member or other planar metal member, etc.). Stiffener 130 may have openings such as screw holes 132 and 134. Metal fasteners such as screws may pass through holes 132 and 134 and may be received within threaded openings in housing 12, metal brackets and other support structures, port connectors, and other structures in device 10. The metal screws may help form grounding paths such as paths 124 of FIG. 4.

Figure 6:
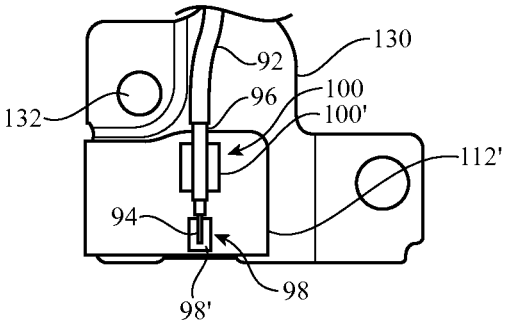
FIG. 6 is a view of an end portion of a coaxial cable that has been coupled to antenna terminals on a portion of the flexible printed circuit of FIG. 5 that is overlapped and supported by the stiffener in accordance with an embodiment.
Figure 7:
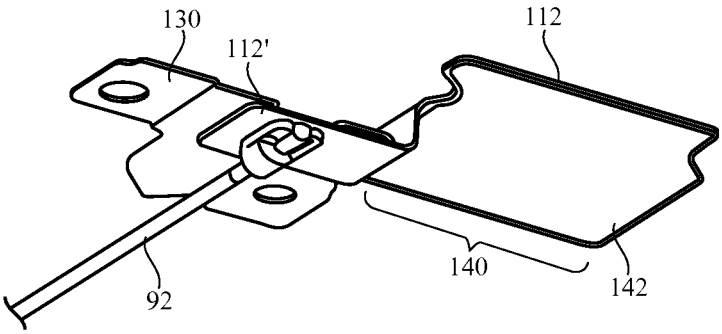
FIG. 7 is a perspective view of the underside of the flexible printed circuit and stiffener of FIGS. 5 and 6 in accordance with an embodiment.

Stiffener 130 may help structurally support flexible printed circuit tail 112' and thereby facilitate attachment of coaxial cable 92 to the underside of tail 112'. FIG. 6 shows how coaxial cable 92 may have a ground conductor (conductor 96) that is coupled to ground pad 100' of tail portion 112' of flexible printed circuit 112 at antenna ground feed 100 and may have a positive signal line conductor (conductor 94) that is coupled to positive signal pad 98' of portion 112' at positive antenna feed 98, thereby forming a feed for antenna 40. A perspective view of the underside of flexible printed circuit 112 showing how stiffener 130 may overlap tail portion 112' and the end of coaxial cable 92 is shown in FIG. 7. A layer of adhesive 142 may be formed under flexible printed circuit 112 in region 140 to help attach flexible printed circuit 112 to the surface of upper wall 110 of speaker box 118.

Figure 8:
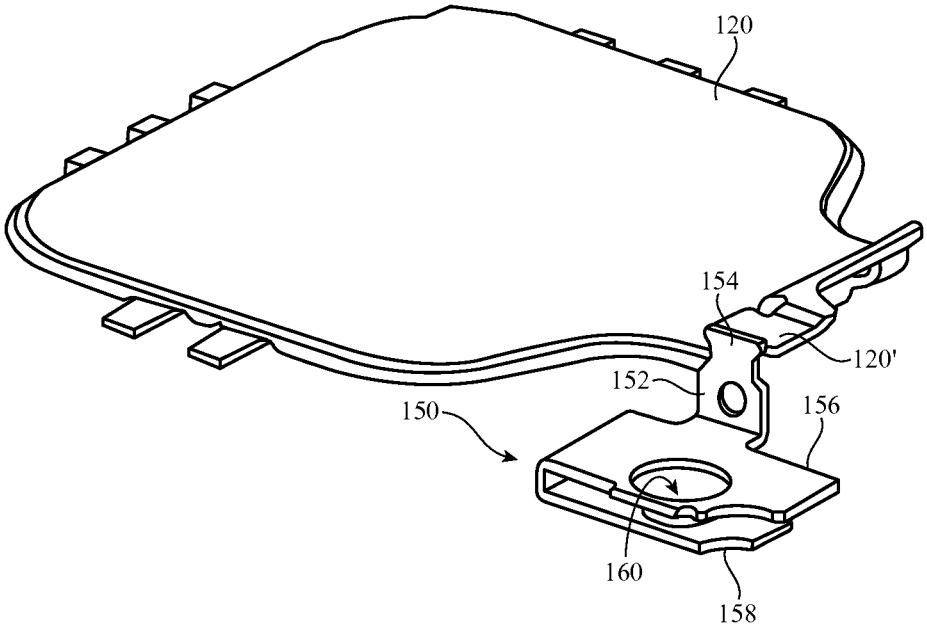
FIG. 8 is a perspective view of an illustrative metal top plate for a speaker box and an associated metal grounding clip in accordance with an embodiment.

FIG. 8 is a perspective view of an illustrative upper metal plate for speaker box 118. As shown in FIG. 8, a metal structure such as clip 150 or other metal member may have a vertically extending portion such as portion 152 that is joined to portion 120' along seam 154. Laser welds, solder, conductive adhesive, and/or other conductive fastening techniques may be used to electrically couple upper metal plate 120 to clip 150 at seam 154. This allows clip 150 to serve as part of a grounding path such as grounding path 124 of FIG. 4.

Clip 150 may have openings such as opening 160 to receive screws (e.g., to help mechanically and/or electrically couple clip 150 to housing 12 and/or other ground structures). The opening may pass through upper clip portion 156 and parallel lower clip portion 158.

Figure 9:
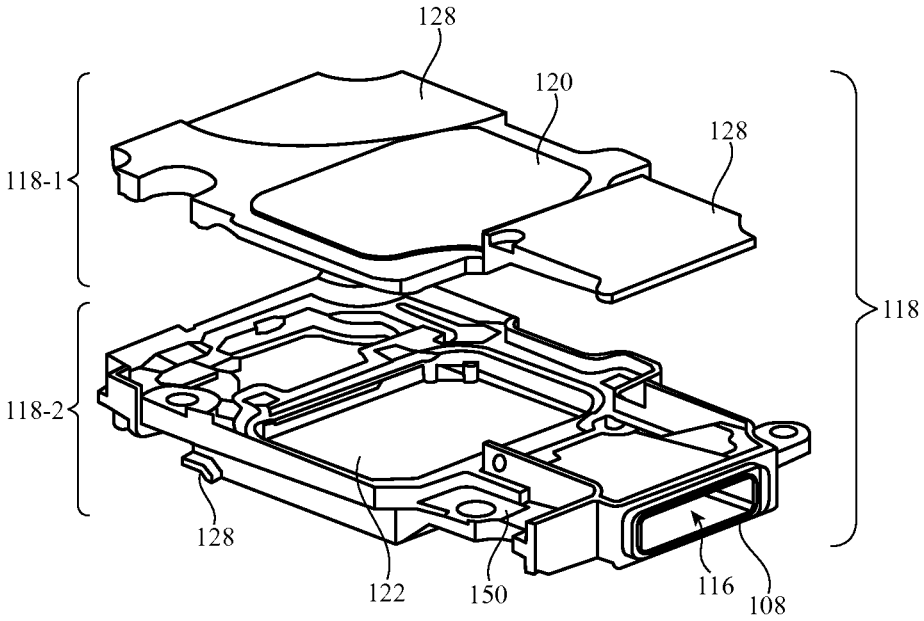
FIG. 9 is an exploded perspective view of an illustrative speaker box having mating upper and lower portions in accordance with an embodiment.

FIG. 9 shows how speaker box 118 may be formed from multiple joined parts. As shown in the illustrative exploded perspective view of FIG. 9, speaker box 118 has an upper portion such as speaker box portion 118-1 and a mating lower portion such as speaker box portion 118-2. Upper portion 118-1 may have metal plate 120 embedded in injection molded plastic 128. Lower portion 118-2 may have metal plate 122 and metal clip 150 embedded in injection molded plastic 128. Speaker box 118 may be formed by moving portion 118-1 towards portion 118-2 to join portions 118-1 and 118-2 together. Ultrasonic welds, adhesive, fasteners, or other attachment mechanisms may be used in joining portions 118-1 and 118-2.

When portions 118-1 and 118-2 are joined, portion 152 of clip 150 will meet portion 120' of plate 120 along seam (joint) 154. Laser welds, solder, and/or conductive adhesive may be used in coupling clip 150 and plate 120 along seam 154 after portions 118-1 and 118-2 have been assembled.

With this approach, clip 150 is joined to plate 120 after upper and lower mating portions of speaker box 118 have been assembled. By delaying the process of joining clip 150 and plate 120 until after speaker box assembly, residual stresses that might otherwise be imparted to speaker box 118 from clip 140 and plate 120 may be minimized. This helps box 118 to maintain desired acoustic properties such as desired acoustic sealing levels.

Figure 10:
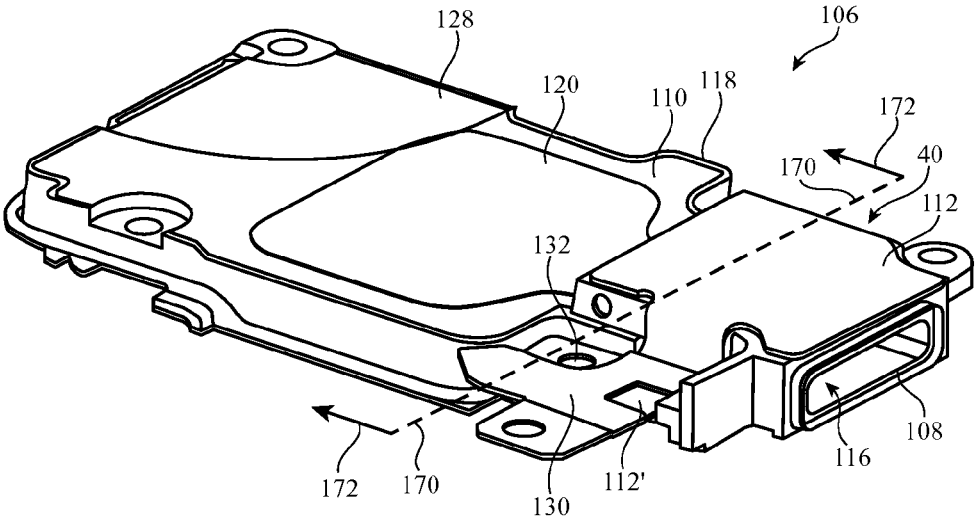
FIG. 10 is a perspective view of an illustrative speaker box that is being used to support an antenna on a flexible printed circuit in accordance with an embodiment.

A perspective view of speaker 106 is shown in FIG. 10. As shown in FIG. 10, a portion of upper surface 110 of speaker box 118 may be formed from metal plate 120 in molded plastic wall portions 128. Stiffener 130 may overlap tail portion 112' of flexible printed circuit 112 for antenna 40, thereby providing both structural support for tail portion 112' and grounding for the conductive structures of speaker box 118. Opening 108 may be formed in a plastic end wall of plastic 128 or from other portions of speaker box 118.

Figure 11:
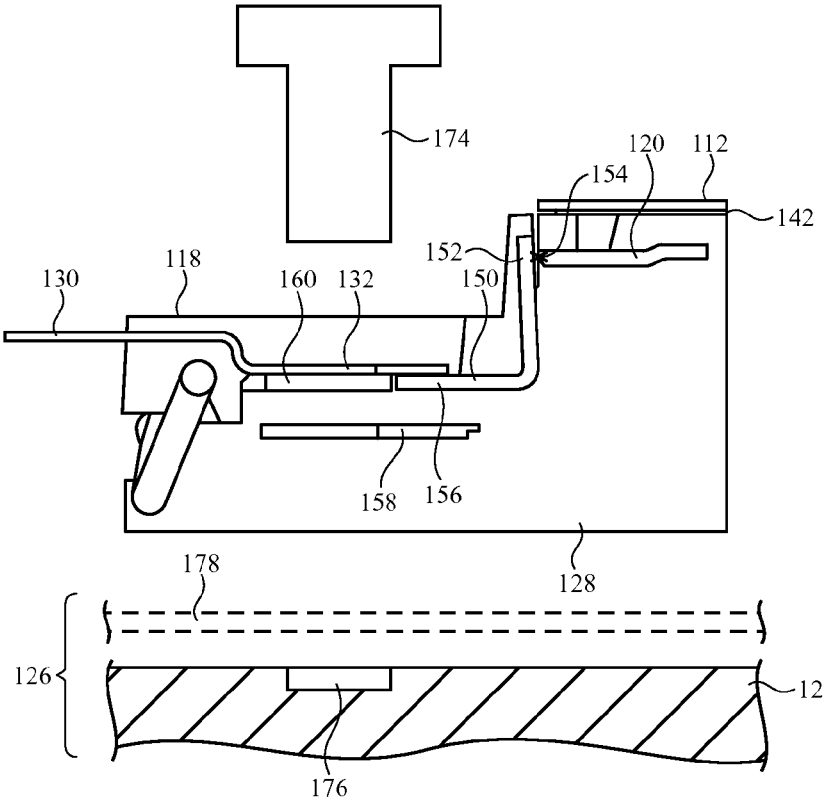
FIG. 11 is a cross-sectional side view of the speaker box of FIG. 10 in accordance with an embodiment.

FIG. 11 is a cross-sectional side view of speaker 106 of FIG. 10 taken along line 170 and viewed in direction 172. As shown in FIG. 11, screw 174 may be received within threaded opening 176 in housing 12, which may serve as ground 126. Screw 174 may pass through an opening in flexible printed circuit 178 (e.g., a flexible printed circuit coupled to a port connector for port 52 and/or other grounded structures). Screw 174 may also pass through opening 132 in stiffener 130, openings such as opening 160 in portions 156 and 158 of clip 150, and an aligned opening in plastic 128 of box 118. Ground 126 may be formed from ground structures in device 10 such as layer 178 (e.g., one or more flexible printed circuit layers such as a flexible printed circuit used for mounting a data port connector within device 10), and/or housing 12. The metal grounding path structures of clip 150, stiffener 130, and screw 174 form a grounding path to ground 126. By grounding metal plate 120 (and, if desired metal plate 122) in this way, electromagnetic noise can be suppressed and antenna performance for antenna 40 can be improved.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a conductive housing structure;

a speaker box having a wall that includes at least one metal structure;

grounding path structures that ground the metal structure to the conductive housing structure; and an antenna supported by the speaker box, wherein the grounding path structures have an opening, are shorted to the metal structure, and comprise a metal fastener that passes through the opening.

2. The electronic device defined in claim 1 wherein the metal structure comprises a metal plate and wherein the speaker box comprises plastic molded over at least part of the metal plate.

3. The electronic device defined in claim 2 wherein the grounding path structures include a metal clip that is shorted to the metal plate.

4. The electronic device defined in claim 3 wherein the opening is formed in the metal clip.

5. The electronic device defined in claim 4 wherein the conductive housing structure comprises a metal housing wall and wherein the metal housing wall has an opening that receives the metal fastener.

6. The electronic device defined in claim 1 wherein the antenna comprises a flexible printed circuit that has metal antenna resonating element traces and that is attached to a surface of the speaker box.

7. An electronic device, comprising:

a conductive housing structure;

a speaker box having a wall that includes at least one metal structure;

grounding path structures that ground the metal structure to the conductive housing structure; and an antenna supported by the speaker box, wherein the grounding path structures include a metal clip and wherein the speaker box includes a first plastic portion in which the metal structure is embedded and includes a second plastic portion in which the metal clip is embedded.

8. The electronic device defined in claim 7 wherein the metal plate and the metal clip are welded together after the first and second portions of the speaker box are joined together to form the speaker box.

9. An electronic device, comprising:

a conductive housing structure;

a speaker box having a wall that includes at least one metal structure;

grounding path structures that ground the metal structure to the conductive housing structure;

an antenna supported by the speaker box, wherein the antenna comprises a flexible printed circuit that has metal antenna resonating element traces and wherein the flexible printed circuit has a tail portion; and a stiffener that overlaps the tail portion.

10. The electronic device defined in claim 9 further comprising a coaxial cable that is coupled to pads on the flexible printed circuit tail portion, wherein the stiffener comprises a metal stiffener and has an opening, and wherein the grounding path structures include the metal stiffener and a metal screw that is shorted between the metal stiffener and the conductive housing structures.

11. The electronic device defined in claim 10 wherein the speaker box comprises plastic and comprises a metal clip that is embedded in the plastic and that is shorted to the metal stiffener, wherein the metal clip forms a portion of the grounding path structures and is shorted to the metal structure.

12. The electronic device defined in claim 11 wherein the metal clip has a hole through which the metal screw passes and wherein the metal structure comprises a metal plate that forms a wall in the speaker box.

13. Apparatus, comprising:

an antenna support structure;

metal traces on the antenna support structure that form an antenna;

a metal stiffener that overlaps a portion of the antenna support structure;

a ground structure; and a grounding path structure that shorts the metal stiffener to the ground structure, wherein the grounding path structure comprises a conductive fastener that fastens the antenna support structure to the ground structure.

14. The apparatus defined in claim 13 wherein the ground structure comprises a metal electronic device housing wall.

15. The apparatus defined in claim 14 wherein the antenna support structure comprises a flexible printed circuit.

16. The apparatus defined in claim 14 further comprising a coaxial cable that is coupled to the portion of the antenna support structure that is overlapped by the metal stiffener, wherein the grounding path structure further comprises a metal clip that is shorted to the metal stiffener.

17. The apparatus defined in claim 16 further comprising a speaker box having plastic structures that are molded over at least part of the metal clip.

18. The apparatus defined in claim 17 further comprising a metal plate that forms a wall for the speaker box, wherein the plastic structures are molded over at least part of the metal plate.

19. An electronic device, comprising:

a metal structure that serves as ground;

a speaker box having plastic portions and at least one metal plate;

a flexible printed circuit having metal traces that form an antenna, wherein the flexible printed circuit is supported by the speaker box; and a coaxial cable coupled to a tail portion of the flexible printed circuit; and a metal stiffener that overlaps the tail portion, wherein the metal stiffener is coupled to the metal plate and is shorted to the metal structure that serves as ground.

20. The electronic device defined in claim 19 wherein the metal structure comprises a metal electronic device housing, the electronic device further comprising:

a metal fastener; and a metal member in the plastic portions of the speaker box, wherein the metal member is electrically coupled to the metal plate and to the metal stiffener and wherein the metal fastener grounds the metal plate, metal member, and metal stiffener to the metal electronic device housing.

* * * * *